US009589494B2

(12) United States Patent
Park et al.

(10) Patent No.: US 9,589,494 B2
(45) Date of Patent: Mar. 7, 2017

(54) DISPLAY DEVICE

(71) Applicant: SAMSUNG DISPLAY CO., LTD., Yongin, Gyeonggi-Do (KR)

(72) Inventors: Sungjae Park, Gangwon-do (KR); Jai-Hyun Koh, Gyeonggi-do (KR); Se Ah Kwon, Seoul (KR); Jinpil Kim, Gyeonggi-do (KR); Kyungsu Lee, Gyeonggi-do (KR); Ik Soo Lee, Seoul (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 68 days.

(21) Appl. No.: 14/604,914

(22) Filed: Jan. 26, 2015

(65) Prior Publication Data

US 2015/0213748 A1 Jul. 30, 2015

(30) Foreign Application Priority Data

Jan. 27, 2014 (KR) ..... 10-2014-0009778

(51) Int. Cl.
*G09G 3/20* (2006.01)

(52) U.S. Cl.
CPC ... *G09G 3/2003* (2013.01); *G09G 2300/0452* (2013.01); *G09G 2320/0242* (2013.01); *G09G 2340/06* (2013.01)

(58) Field of Classification Search
CPC ..... G09G 3/2003; G09G 2340/06; G09G 2300/0452; G09G 2320/0242; G02F 1/133514
See application file for complete search history.

(56) References Cited

U.S. PATENT DOCUMENTS

| | | | |
|---|---|---|---|
| 7,495,722 | B2 | 2/2009 | Roth et al. |
| 7,876,339 | B2 | 1/2011 | Okazaki et al. |
| 8,294,741 | B2 | 10/2012 | Elliott et al. |
| 8,451,302 | B2 | 5/2013 | Yoshida et al. |
| 8,488,085 | B2 | 7/2013 | Nakamura et al. |
| 2005/0134785 | A1 | 6/2005 | Roth et al. |
| 2007/0057901 | A1 | 3/2007 | Chino |

(Continued)

FOREIGN PATENT DOCUMENTS

KR 1020050067908 7/2005

*Primary Examiner* — Liliana Cerullo
(74) *Attorney, Agent, or Firm* — F. Chau & Associates, LLC

(57) ABSTRACT

A display device includes pixel patterns to display an image. Each pixel pattern is repetitively arranged in row and column directions, including primary pixels, first complex pixels and second complex pixels. Each primary pixel is composed of two primary color sub-pixels configured to provide two primary colors of three primary colors, wherein the three primary colors comprise red, green and blue. Each first complex pixel is composed of one primary color sub-pixel configured to provide a remaining primary color of the three primary colors and a first non-primary color sub-pixel configured to provide a first color selected from non-primary colors, wherein the non-primary colors are different from the three primary colors. Each complex pixel is composed of one primary color sub-pixel configured to provide the remaining primary color and a second non-primary color sub-pixel configured to provide a second color selected from the non-primary colors.

18 Claims, 9 Drawing Sheets

(56) References Cited

U.S. PATENT DOCUMENTS

| | | | | |
|---|---|---|---|---|
| 2007/0268208 | A1* | 11/2007 | Okada | G02F 1/133514 345/55 |
| 2008/0316235 | A1* | 12/2008 | Okazaki | G02F 1/133514 345/694 |
| 2010/0207969 | A1 | 8/2010 | Ueki et al. | |

* cited by examiner

DISPLAY DEVICE

CROSS-REFERENCE TO RELATED APPLICATION

This application claims priority under 35 U.S.C. §119 to Korean Patent Application No. 10-2014-0009778, filed on Jan. 27, 2014 in the Korean Intellectual Property Office, the disclosure of which is incorporated by reference herein in its entirety.

TECHNICAL FILED

The present invention relates to a display device.

DISCUSSION OF RELATED ART

Display panels display color images using pixels including sub-pixels formed of three primary colors—red, green and blue. By using a combination of the three primary colors, virtually all colors discernible to human eyes can be presented. Hereinafter, red, green and blue primary colors may be referred to as primary colors, and other colors except the three primary colors may be referred to as non-primary colors.

SUMMARY

According to an exemplary embodiment of the present invention, a display device includes a plurality of pixel patterns configured to display an image. Each of the plurality of pixel patterns is repetitively arranged in row and column directions. Each pixel pattern includes a plurality of primary pixels, a plurality of first complex pixels and a plurality of second complex pixels. Each primary pixel is composed of two primary color sub-pixels configured to provide two primary colors of three primary colors, wherein the three primary colors comprise red, green and blue. Each first complex pixel is composed of one primary color sub-pixel configured to provide a remaining primary color of the three primary colors and a first non-primary color sub-pixel configured to provide a first color selected from non-primary colors, wherein the non-primary colors are different from the three primary colors. Each complex pixel is composed of one primary color sub-pixel configured to provide the remaining primary color and a second non-primary color sub-pixel configured to provide a second color selected from the non-primary colors.

According to an exemplary embodiment of the present invention, a display device includes a plurality of pixel patterns configured to display an image. Each of the plurality of pixel patterns is repetitively arranged in row and column directions. Each pixel pattern comprises a plurality of first pixels, and a plurality of second pixels. Each of the plurality of the first pixels is composed of two primary color sub-pixels configured to provide two primary colors of a plurality of primary colors. Each of the plurality of the second pixels is composed of one primary color sub-pixel configured to provide a primary color different from the two primary colors of the primary colors and a first non-primary color sub-pixel configured to provide a first color selected from the non-primary colors, wherein the non-primary colors different from the primary colors. Each of the plurality of the first pixels is adjacent to the at least one of the plurality of the second pixels in the row or the column directions.

BRIEF DESCRIPTION OF THE DRAWINGS

These and other features of the present invention will become more apparent by describing in detail exemplary embodiments thereof with reference to the accompanying drawings of which.

DETAILED DESCRIPTION OF EXEMPLARY EMBODIMENTS

Figure 1:
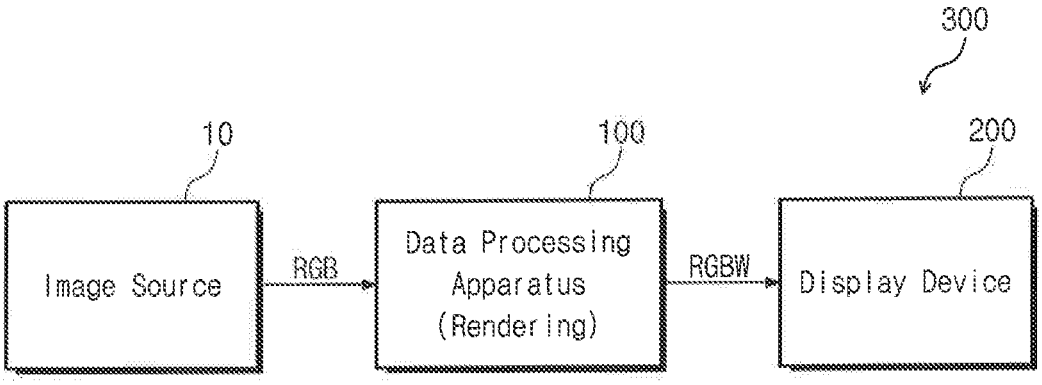
FIG. 1 is a block diagram of a display system of a display device according to an exemplary embodiment of the present invention.

Exemplary embodiments of the present invention will be described below in detail with reference to the accompanying drawings. However, the present invention may be embodied in different forms and should not be construed as limited to the embodiments set forth herein. In the drawings, the thickness of layers and regions may be exaggerated for clarity. It will also be understood that when an element is referred to as being "on" another element or substrate, it may be directly on the other element or substrate, or intervening layers may also be present. It will also be understood that when an element is referred to as being "coupled to" or "connected to" another element, it may be directly coupled to or connected to the other element, or intervening elements may also be present. Like reference numerals may refer to the like elements throughout the specification and drawings.

FIG. 1 is a block diagram of a display system 300 of a display device 200 according to an exemplary embodiment of the present invention. Referring to FIG. 1, the display system 300 includes an image source 10 outputting image data RGB, a data processing apparatus 100 rendering the image data RGB, and the display device 200 displaying images using image data RGBW.

The image source 10 outputs the image data RGB formed of red, green, and blue image data. Herein, the image source 10 may be an electronic device such as a personal computer, a television set, a video player, and a digital cellular phone.

The image data RGB outputted from the image source 10 are transferred to the data processing apparatus 100. The data processing apparatus 100 generates the image data RGBW from the image data RGB and provides the display device 200 with the image data RGBW. Herein, the image data RGBW is formed of data corresponding to logic pixels of the display device 200.

The data processing apparatus 100 maps the image data RGB formed of the red, green, and blue data to the image data RGBW having red, green, blue and additional color. Herein, the additional color is at least another color that is not one of red, green, and blue.

The image data RGBW is formed of color data represented by respective sub-pixels included in the display device 200. If the sub-pixels are formed of red, green, blue, cyan, yellow, and white sub-pixels, the image data RGBW is formed of red, green, blue, cyan, yellow, and white data. The data processing apparatus 100 may map an RGB color gamut formed of red, green, blue data into a color gamut formed of red, green, blue, and the additional color by using a gamut mapping algorithm (GMA).

The display panel 210 includes logic pixels. For example, the display panel 210 includes a pixel pattern formed of 116 logic pixels. The logic pixels correspond to the pixels. The pixel patterns $PT_{11}$ and $PT_{12}$ may be repetitively disposed in the entire surface of the display panel 210.

Data correspond to the respective pixels and are formed of red, green, blue, and additional data. However, the respective pixels may provide only some of red, green, blue, and the additional color. For example, the respective pixels are formed of two colors of red, green, blue, and the additional color. The additional color may include at least two non-primary colors different from the three primary colors of red, green and blue. The respective pixels only represent a color corresponding to the sub-pixel. The pixels and the pixel patterns will be described below in detail.

On the other hand, the data processing apparatus 100 may linearize the image data RGB using a gamma function before rendering the image data RGB. Also, the data processing apparatus 100 may provide nonlinear image data RGBW by using an inverse gamma function.

The display device 200 displays images using the image data RGBW. The display device 200 includes a liquid crystal display (LCD), an electrophoresis display, an organic light emitting display (OLED), or an electrowetting display, but the present invention is not limited thereto. Hereinafter, a detailed description will be described later.

Figure 2:
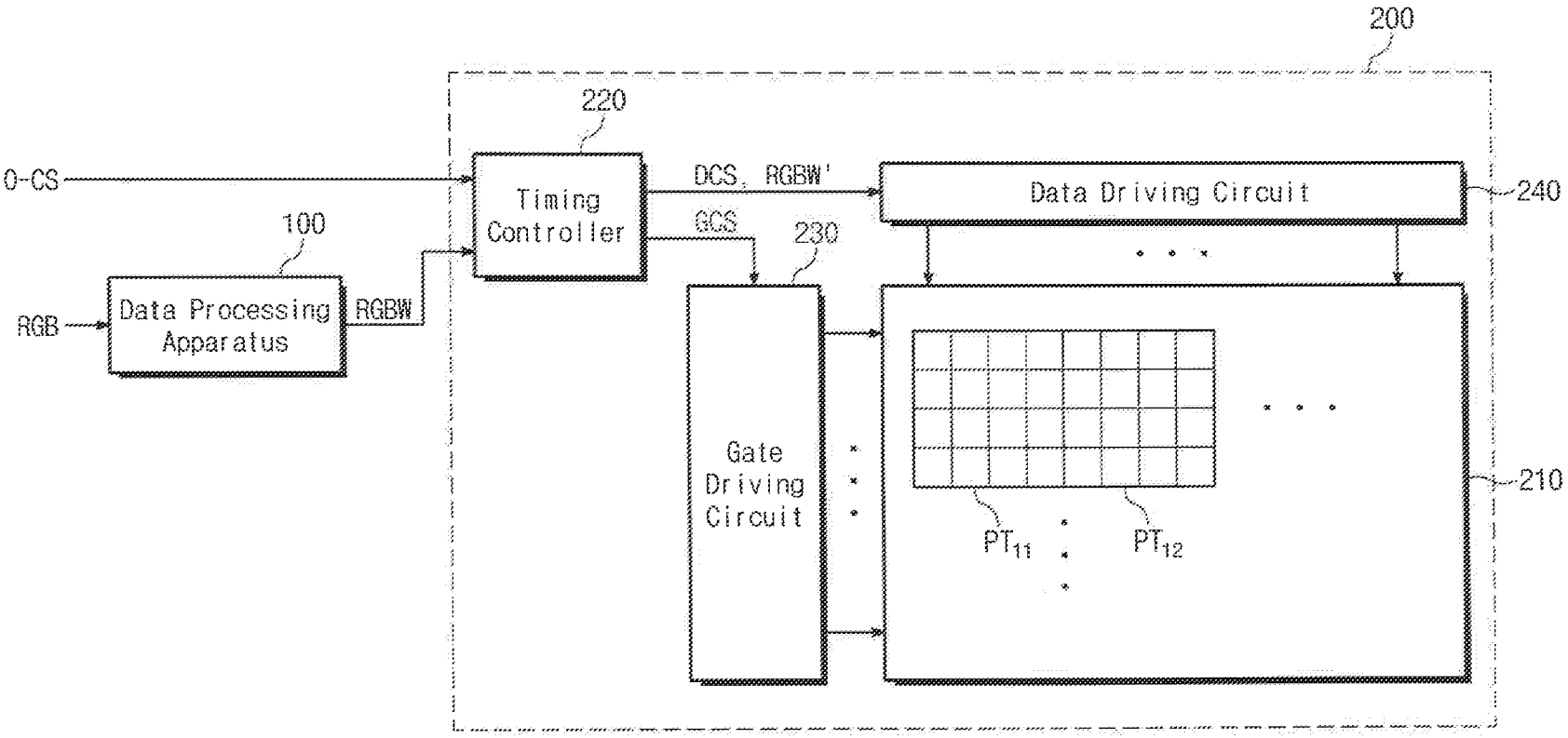
FIG. 2 is a block diagram of the display device 200 of FIG. 1.

FIG. 2 is a block diagram of the display device 200. The display device 200 includes a display panel 210, a timing controller 220, a gate driving circuit 230, and a data driving circuit 240.

The display panel 210 includes a screen displaying images. The display panel 210 includes pixels. The pixels may be formed of a pentile structure or a multi-primary color (MPC) structure.

The pixels form a pixel pattern $PT_{11}$ repetitively arranged. The data processing apparatus 100 renders the image data RGB according to a layout of the sub-pixels.

The data processing apparatus 100 provides the image data RGBW to the timing controller 220. The data processing apparatus 100 may compensate the rendered data using a color compensation module (not shown) and may provide the compensated data to the timing controller 220. Alternatively, the timing controller 220 or a component of the display device 200 may include the color compensation module.

The timing controller 220 receives the rendered image data RGBW from the data processing apparatus 100 as sub-pixel data, converts the rendered image data RGBW to have an appropriate data format, and provides the data driving circuit 240 with the converted data RGBW. The timing controller 220 may receive and convert all types of control signals O-CS into a data control signal DCS and a gate control signal GCS, respectively, and may provide the data driving circuit 240 and the gate driving circuit 230 with the data control signal DCS and the gate control signal GCS, respectively.

The data driving circuit 240, in response to the data control signal DCS, converts the converted data RGBW to a data voltage and provides the display panel 210 with the data voltage. The gate driving circuit 230, in response to the gate control signal GCS, sequentially outputs a gate signal to drive the pixels in a row.

Figure 3:
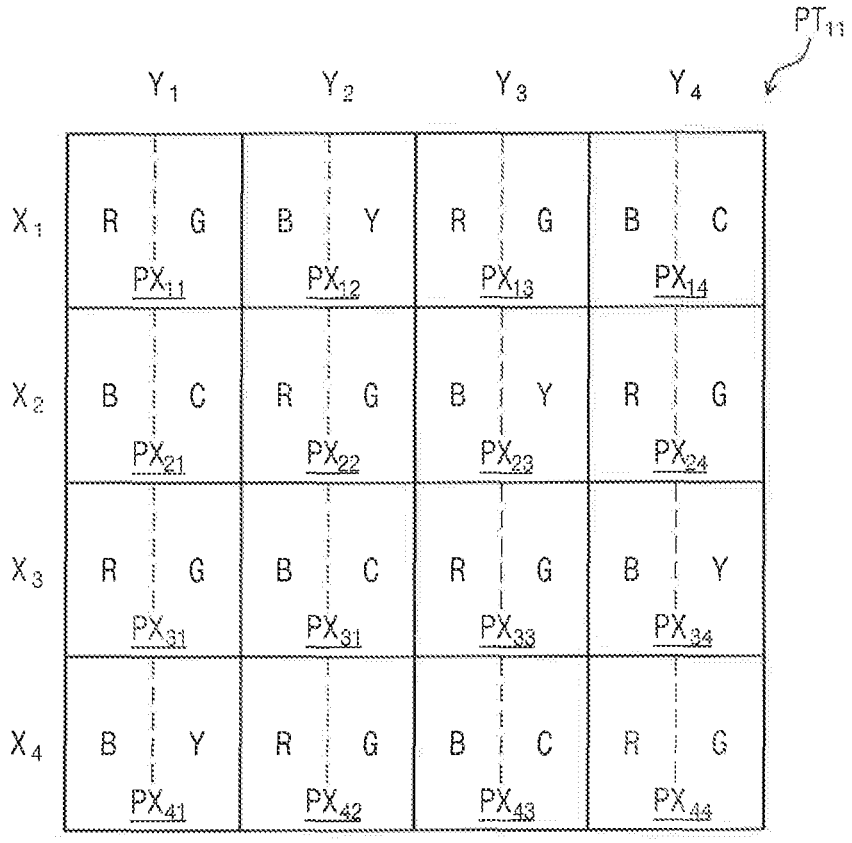
FIG. 3 is a view illustrating a pixel pattern according to an exemplary embodiment of the present invention.
Figure 4:
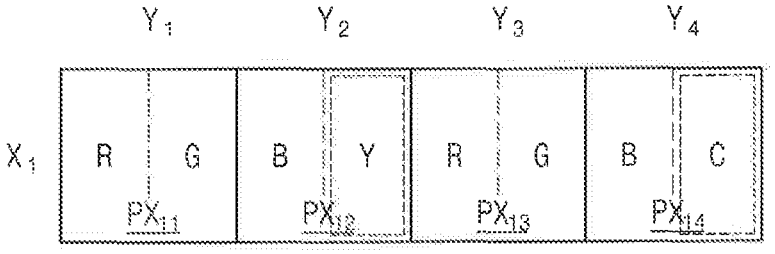
FIG. 4 illustrates a part of the pixel pattern shown in FIG. 3.
Figure 5:
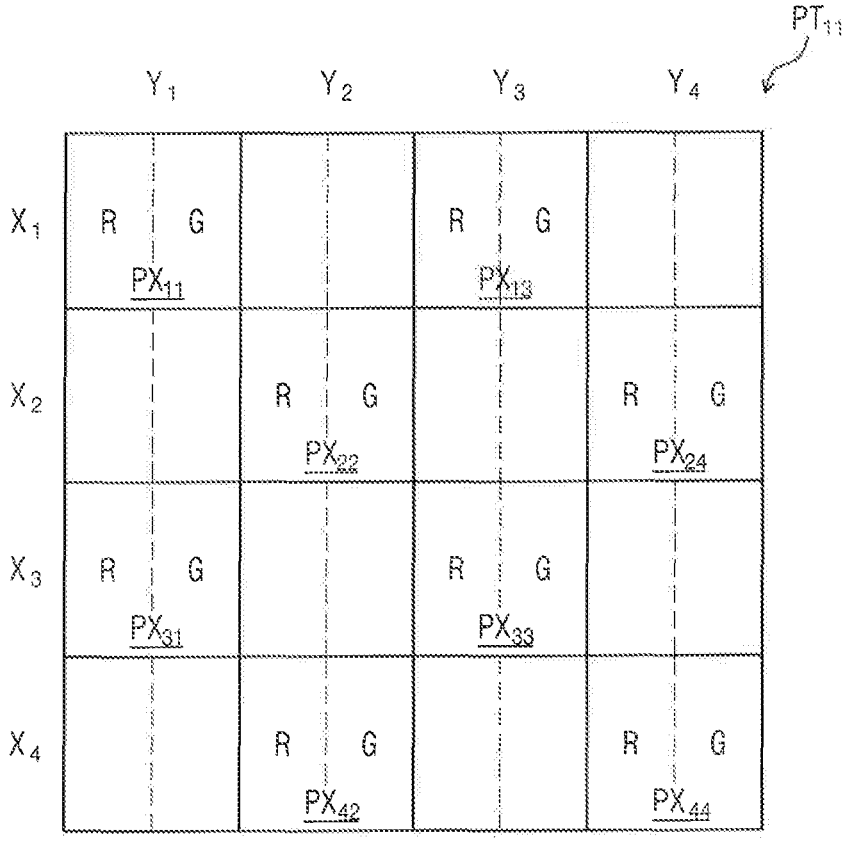
FIG. 5 illustrates a part of the pixel pattern shown in FIG. 3.

FIG. 3 is a view illustrating a pixel pattern $PT_{11}$ according to an exemplary embodiment of the present invention. FIG. 4 illustrates a part of the pixel pattern shown $PT_{11}$. FIG. 5 illustrates a part of the pixel pattern shown $PT_{11}$.

FIGS. 3 and 5 illustrate examples of the pixel pattern $PT_{11}$ having a 4×4 matrix, and FIG. 4 illustrates pixels $PX_{11}$ to $PX_{14}$ arranged in a first row $X_1$ that is a part of the pixel pattern $PT_{11}$. Referring to FIG. 3, the pixel pattern $PT_{11}$ may include pixels $PX_{11}$ to $PX_{44}$ arranged in four rows $X_1$ to $X_4$ and four columns $Y_1$ to $Y_4$.

The pixels $PX_{11}$ to $PX_{44}$ include at least two sub-pixels, respectively. The sub-pixels may include a primary color sub-pixel and an additional color sub-pixel.

The primary color sub-pixel may be one of a red sub-pixel, a green sub-pixel, and a blue sub-pixel. The primary color sub-pixel may be one of a red sub-pixel, a green sub-pixel, and a blue sub-pixel. On the other hand, the primary color and the additional color are just examples and may further include different colors in other exemplary embodiments.

The pixels $PX_{11}$ to $PX_{44}$ are formed of two sub-pixels having different colors, respectively. For example, the pixel $PX_{11}$ may be referred to as a primary pixel that is formed of the primary color sub-pixels only. The pixel $PX_{12}$ may be referred to as a complex pixel that is formed of a primary color sub-pixel and a non-primary color sub-pixel. The primary pixel and the complex pixel are alternately arranged in a row direction.

For example, two sub-pixels forming each of the primary pixels may be one selected from the primary color sub-pixels and another selected from the primary color sub-pixels. Two sub-pixels forming each of the complex pixels may be one selected from the primary color sub-pixels and one selected from the additional color sub-pixels.

At least two of pixels arranged in the respective rows $X_1$ to $X_4$ of the pixel pattern $PT_{11}$ may be the primary pixels. For example, among pixels disposed in the first row $X_1$, a first pixel $PX_{11}$ disposed in a first column $Y_1$ and a third pixel $PX_{13}$ disposed in a third column $Y_3$ include red and green sub-pixels, respectively. On the other hand, in other exemplary embodiments, the first pixel $PX_{11}$ and the third pixel $PX_{13}$ may include mutually different sub-pixels.

Also, at least one of the pixels arranged in the respective rows $X_1$ to $X_4$ of the pixel pattern $PT_{11}$ may be the complex pixel. In the exemplary embodiment, the pixel pattern $PT_{11}$ includes two complex pixels for each row.

For example, among the pixels arranged in the first row $X_1$, a second pixel $PX_{12}$ disposed in a second column $Y_2$ includes blue and yellow sub-pixels. Also, a fourth pixel $PX_{14}$ disposed in a fourth column $Y_4$ of the first row includes blue and cyan sub-pixels. The second pixel $PX_{12}$ and the fourth pixel $PX_{14}$ include mutually different additional color sub-pixels. However, in other exemplary embodiments, the second pixel $PX_{12}$ and the fourth pixel $PX_{14}$ may include the same additional color sub-pixels.

Referring to FIGS. 3 and 4, the pixel pattern $PT_{11}$ includes pixels $PX_{11}$ to $PX_{14}$. The pixels $PX_{11}$ to $PX_{14}$ include sub-pixels different from sub-pixels of adjacent pixels. The adjacent pixels of a pixel may include pixels positioned above, below, left and/or right to the pixel.

For example, if a second pixel $PX_{12}$ includes blue and yellow sub-pixels, its adjacent pixels $PX_{11}$, $PX_{13}$, and $PX_2$ include red and green sub-pixels which are different from the sub-pixels of the second pixel $PX_{12}$. The blue sub-pixel or the yellow sub-pixel forming the second pixel $PX_{12}$ are not present in the adjacent pixels $PX_{11}$, $PX_{13}$ and $PX_{22}$ For a third pixel $PX_{13}$, its adjacent pixels $PX_{12}$, $PX_{14}$ and $PX_{23}$ include sub-pixels different from sub-pixels of the third pixel $PX_{13}$. The third pixel $PX_{13}$ includes red and green sub-pixels. The adjacent pixels $PX_{12}$ and $PX_{23}$ include blue and yellow sub-pixels, and the adjacent pixel $PX_{14}$ includes blue and cyan sub-pixels.

Referring to FIG. 3, the pattern as described above is shown in pixels adjacent to top and bottom thereof. On a bottom of the second pixel $PX_{12}$, a pixel including the same sub-pixels as the first pixel $PX_{11}$ is disposed. Accordingly, on the bottom of the second pixel $PX_{12}$, a red sub-pixel or a green sub-pixel is disposed. In a point of view of regularly arranging the pixel pattern $PT_{11}$, when being arranged in the same order, a pixel adjacent to the top of the second pixel $PX_{12}$ may be formed of a red sub-pixel and a green sub-pixel excluding a blue sub-pixel.

On the other hand, pixels arranged in each row of the pixel $PT_{11}$ are arranged in the same order as the pixels $PX_{11}$ to $PX_{14}$ arranged in the first row $X_1$ are sequentially shifted in a longitudinal direction. For example, the pixels $PX_{21}$ to $PX_{24}$ arranged in the second row $X_2$ are configured in the same order as a configuration of a fourth pixel—a first pixel—a second pixel—a third pixel in the longitudinal direction. Also, the pixels $PX_{31}$ to $PX_{34}$ arranged in the third row $X_3$ are configured in the same order as a configuration of a third pixel—a fourth pixel—a first pixel—a second pixel in the longitudinal direction. The pixels $PX_{41}$ to $PX_{44}$ arranged in the fourth row $X_4$ are configured in the same order as a configuration of a second pixel—a third pixel—a fourth pixel—a first pixel in the longitudinal direction.

Referring to FIG. 5, in detail, in the pixel pattern $PT_{11}$, pixels forming of the primary sub-pixels are arranged diagonally. For example, the first pixel $PX_{11}$ formed of red and green sub-pixels and the pixels $PX_{22}$, $PX_{33}$, and $PX_{44}$ formed of same colors as the first pixel $PX_{11}$ are arranged diagonally from the first pixel $PX_{11}$.

Not shown in the drawing, although having a different color configuration from the first pixel $PX_{11}$, when the third pixel $PX_{13}$ is formed only of the primary color sub-pixels, pixels having the same color configuration as the third pixel $PX_{13}$ are arranged diagonally from the third pixel $PX_{13}$. For example, the pixels having the same color configuration as the first pixel $PX_{11}$ may be arranged diagonally crossing the pixel pattern $PT_{11}$. The pixels having the same color configuration as the third pixel $PX_{13}$ may be arranged in a diagonal from the third pixel $PX_{13}$.

The pixel arrangement in the pixel pattern $PT_{11}$ as described above allows colors of pixels forming the pixel pattern $PT_{11}$ to be uniformly disposed and allows adjacent pixels to be formed of different colors without overlapping of colors.

One pixel represents one logic pixel and is formed of two sub-pixels to increase transmittance of the pixel. Use of three primary colors—red, blue, and green colors and additional colors such as cyan and yellow increases color reproducibility. The pixel pattern $PT_{11}$ may provide an image representing improved color sense with respect to the same information.

The use of non-primary colors such as cyan and yellow colors enables the pixel pattern PT11 to represent more vivid colors without compromise in brightness color sense compared with the use of the primary colors only. The non-primary colors may also include a while color other than the yellow and cyan colors. Compared with the use of three primary colors only, the pixel pattern $PT_{11}$ may be designed with a higher degree of freedom, thereby representing a relatively broader color region.

The pixel pattern $PT_{11}$ includes a pixel having first primary color sub-pixels and adjacent pixels having a second primary color sub-pixel and a non-primary color sub-pixel. As such, two pixels adjacent to each other in a row include three primary color sub-pixels—red, blue, green sub-pixels—, and a non-primary color sub-pixels.

In a sub-pixel rendering process, respective pixels represent various colors by mixing together with colors of adjacent pixels thereof. Since adjacent pixels are formed of various colors without mutual overlapping in the pixel pattern $PT_{11}$, color reproducibility of an image may be increased using a small number of sub-pixels.

Figure 6:
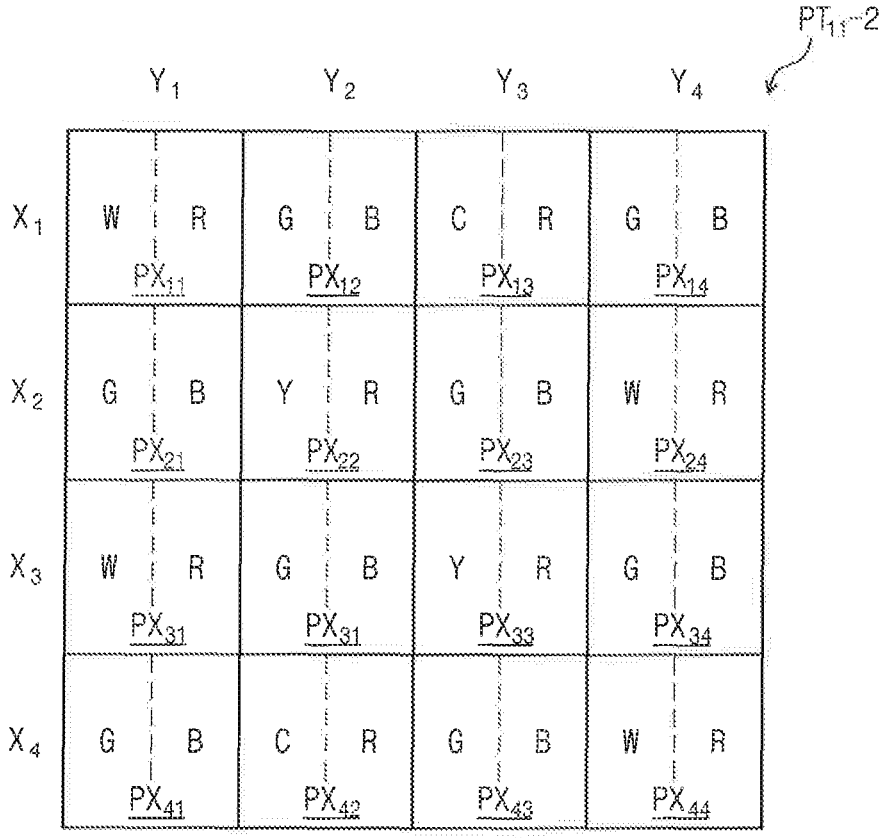
FIG. 6 is a view illustrating a pixel pattern according to an exemplary embodiment of the present invention.
Figure 7:
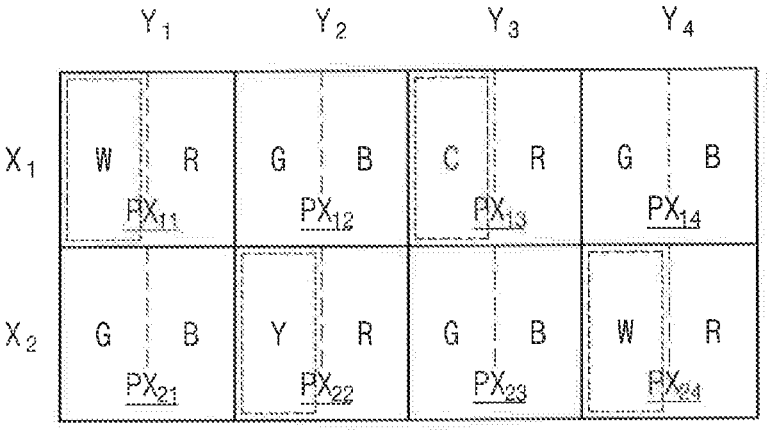
FIG. 7 illustrates a part of the pixel pattern shown in FIG. 6.
Figure 8:
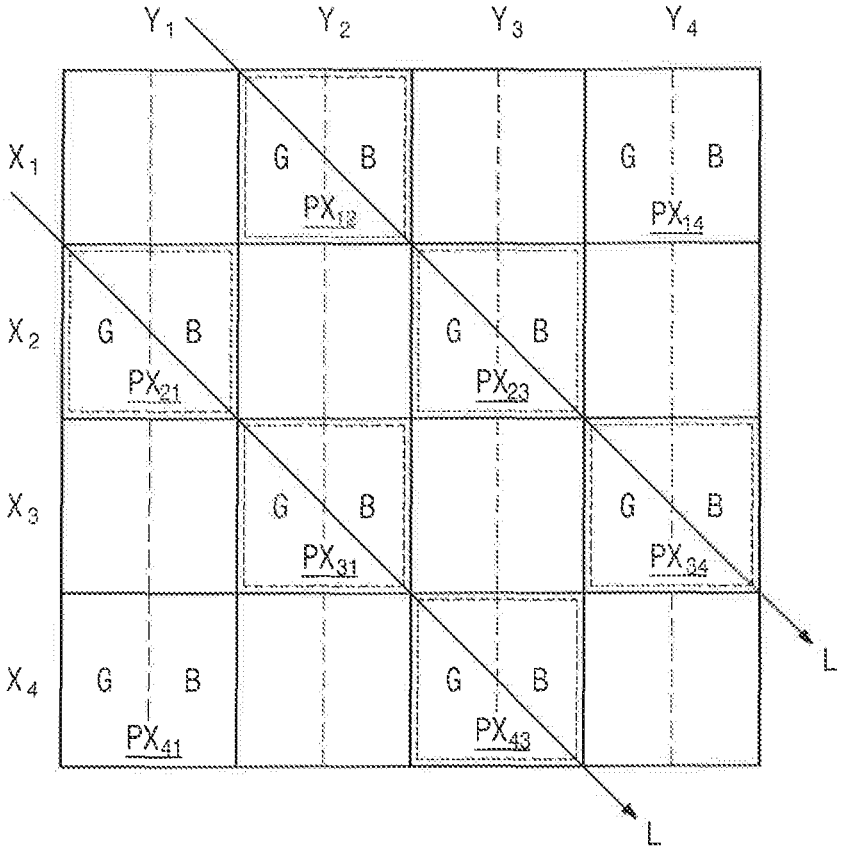
FIG. 8 illustrates a part of the pixel pattern shown in FIG. 6.
Figure 9:
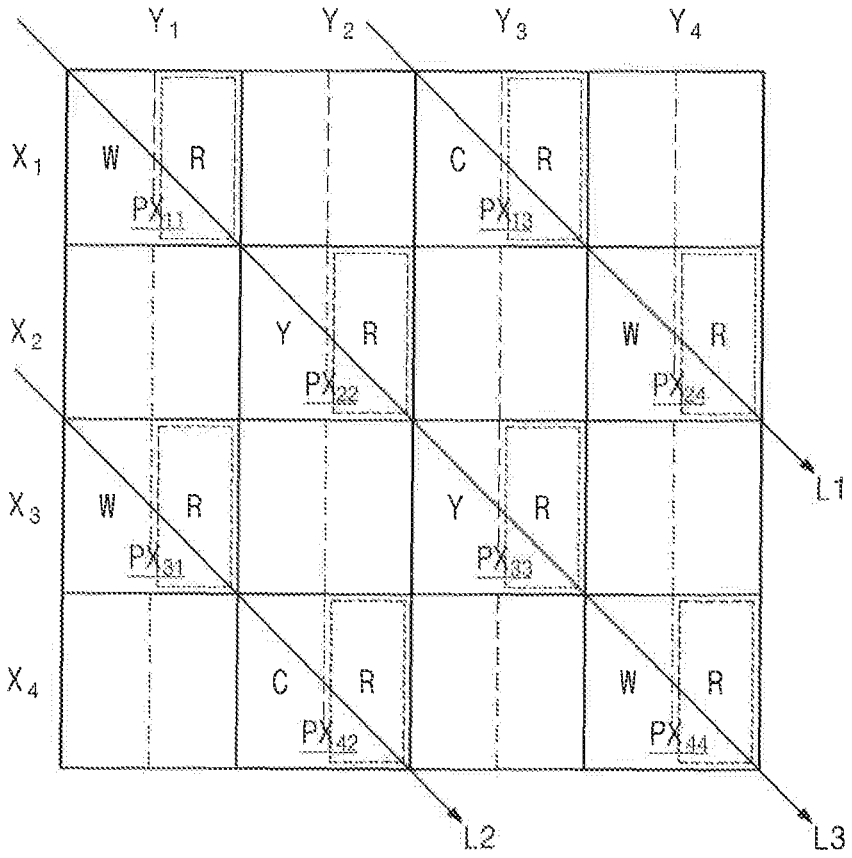
FIG. 9 illustrates a part of the pixel pattern shown in FIG. 6.

FIG. 6 is a view illustrating a pixel pattern $PT_{11}$-2 according to an exemplary embodiment of the present invention. FIG. 7 illustrates a part of the pixel pattern $PT_{11}$-2 shown in FIG. 6. FIG. 8 illustrates a part of the pixel pattern $PT_{11}$-2 shown in FIG. 6. FIG. 9 illustrates a part of the pixel pattern $PT_{11}$-2 shown in FIG. 6. FIGS. 6 to 9 illustrate the pixel pattern $PT_{11}$-2 having a 4×4 matrix including four rows $X_1$ to $X_4$ and four columns $Y_1$ to $Y_4$.

Pixels $PX_{11}$ to $PX_{44}$ forming the pixel pattern $PT_{11}$-2 are formed of two sub-pixels, respectively. The pixel $PX_{11}$ is formed of one primary color sub-pixel and one non-primary color sub-pixel. For example, the one primary color sub-pixel represents a red primary color, and the one non-primary color sub-pixel represents a white color. The pixel PX12 is formed of two primary color sub-pixels. For example, two primary color sub-pixels represent green and blue primary colors, respectively. The first and fourth rows such as X1 and X4 include the same pixels as each other. The second and third rows such as X2 and X3 include the same pixels as each other. A pixel formed of primary color sub-pixels only is adjacent to pixels including a non-primary color sub-pixels such as white, cyan and yellow color sub-pixels.

In FIG. 7, a first row $X_1$ and a second row $X_2$ of the pixel pattern $PT_{11}$-2 are shown. A pixel formed of primary color sub-pixels is adjacent to pixels including a non-primary color sub-pixel. For example, a pixel $PX_{12}$ is formed of two primary colors of green and blue colors only, and its adjacent pixels $PX_{11}$, $PX_{12}$ and $PX_{22}$ include a white color sub-pixel W, a cyan color sub-pixel C and a yellow color sub-pixel Y, respectively.

In the pixel pattern $PT_{11}$-2, each of rows $X_1$ to $X_4$ includes a white subpixel. A cyan sub-pixel and a yellow sub-pixel are alternately arranged in rows. For example, the first and third rows X1 and X3 include a cyan sub-pixel, and the second and fourth rows X2 and X4 include a yellow sub-pixel.

Referring to FIG. 8, pixels formed of primary colors only are diagonally arranged. For example, pixels $PX_{21}$, $PX_{31}$, and $PX_{43}$ are formed of green and blue primary color sub-pixels, and are diagonally arranged in a direction L. The pixels $PX_{12}$, $PX_{23}$ and $PX_{34}$ are formed of green and blue primary color sub-pixels, and are diagonally arranged in the direction L. The pixels formed of two primary color sub-pixels are separated from each other in column and row directions by a pixel including a non-primary color subpixel. Referring to FIG. 9, complex pixels forming the pixel pattern $PT_{11}$-2 are diagonally arranged between pixels formed of two primary color sub-pixels only.

The complex pixels include a red color sub-pixel along with a non-primary color sub-pixels. As such, red primary color sub-pixels are diagonally arranged.

The first and fourth rows include complex pixels having a white color sub-pixel and a cyan color sub-pixel. Pixels $PX_{11}$ and $PX_{13}$ of the first row X1 and pixels $PX_{44}$ and $PX_{42}$ of the fourth row X4 include a white color sub-pixel W and a cyan color sub-pixel C. The second and third rows X2 and X3 include complex pixels including a white color sub-pixel and a yellow color sub-pixel. Pixels $PX_{22}$ and $PX_{24}$ of the second row X2 and pixels $PX_{33}$ and $PX_{31}$ of the third row X3 include a white color sub-pixel W and a yellow color sub-pixel Y.

A diagonal line L3 including pixels $PX_{11}$, $PX_{22}$, $PX_{33}$, and $PX_{44}$ includes white and yellow non-primary color subpixels. The white and yellow non-primary color sub-pixels are alternately arranged along the diagonal line L3.

Referring back to FIG. 6, two adjacent pixels in a row direction include three primary color sub-pixels and a non-primary color sub-pixel. The non-primary color sub-pixel includes white, yellow and cyan sub-pixels.

The pixel pattern $PT_{11}$-2, compared with the pixel pattern $PT_{11}$ described with reference to FIGS. 3 to 5, further includes white subpixels. The pixel pattern $PT_{11}$-2 includes the non-primary white color pixels, thereby providing an image having high transmittance and brightness.

Figure 10:
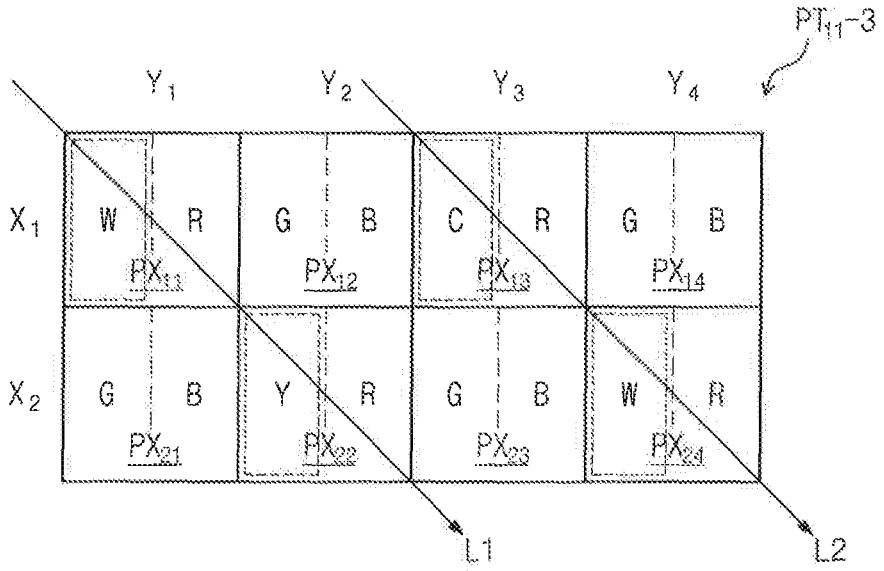
FIG. 10 is a view illustrating a pixel pattern according to an exemplary embodiment of the present invention.

FIG. 10 is a view illustrating a pixel pattern $PT_{11}$-3 according to an exemplary embodiment of the present invention. FIG. 10 illustrates the pixel pattern $PT_{11}$-3 having a 4×2 matrix including two rows $X_1$ and $X_2$ and four columns $Y_1$ to $Y_4$.

Referring to FIG. 10, the pixel pattern $PT_{11}$-3 includes eight pixels $PX_{11}$ to $PX_{24}$.

In a first row X1, pixels $PX_{12}$ and $PX_{14}$ are formed of two primary color sub-pixels only. For example, the two primary color sub-pixels include a green color sub-pixel G and a blue color sub-pixel B. Pixels $PX_{11}$ and $PX_{13}$ are formed of one primary color sub-pixel and one non-primary color sub-pixel. For example, the one primary color sub-pixel represents a red primary color, and the one non-primary color sub-pixel includes white and cyan colors. The pixel $X_{11}$ includes a non-primary color sub-pixel for the white color. The pixel $X_{13}$ includes a non-primary color sub-pixel for the cyan color.

In a second row X2, pixels $PX_{21}$ and $PX_{23}$ are formed of two primary color sub-pixels only. For example, the two primary color sub-pixels include a green color sub-pixel G and a blue color sub-pixel B. Pixels $PX_{22}$ and $PX_{24}$ are formed of one primary color sub-pixel and one non-primary color sub-pixel. For example, the one primary color sub-pixel represents a red primary color, and the one non-primary color sub-pixel includes white and yellow colors. The pixel $X_{22}$ includes a non-primary color sub-pixel for the yellow color. The pixel $X_{24}$ includes a non-primary color sub-pixel for the white color.

The pixels $PX_{12}$, $PX_{14}$, $PX_{21}$ and $PX_{23}$ formed of two primary colors only are separated from each other using non-primary color sub-pixels $PX_{11}$, $PX_{22}$, $PX_{13}$ and $PX_{24}$. In a row direction, the pixels $PX_{12}$, $PX_{14}$, $PX_{21}$, and $PX_{23}$ formed of two primary color sub-pixels and the pixels $PX_{11}$, $PX_{13}$, $PX_{22}$, and $PX_{24}$ including a non-primary color sub-pixel are alternately disposed.

The pixels $PX_{11}$, and $PX_{22}$ that are formed of two primary color sub-pixels are diagonally arranged. The pixels $PX_{13}$ and $PX_{24}$ that are formed of two primary color sub-pixels are diagonally arranged.

For example, the pixels $PX_{11}$ and $PX_{22}$ forming a first diagonal line L1 include a white sub-pixel and a yellow sub-pixel, respectively. For example, the pixels $PX_{13}$ and $PX_{24}$ forming a second diagonal line L2 include a cyan sub-pixel and a white sub-pixel, respectively. The pixels $PX_{11}$ and $PX_{22}$, and the pixels $PX_{13}$ and $PX_{24}$ include a common primary color of a red color which is not included in pixels formed of the two primary color sub-pixels of blue and green primary colors.

An array as described above allows adjacent pixels to have mutually different colors. The pixel $PX_{12}$ disposed in the first row and the second column includes green and blue sub-pixels, and pixels adjacent to the pixel $PX_{12}$ are disposed with sub-pixels having different colors from green and blue colors. For example, sub-pixels having red, white, yellow, and cyan colors may be disposed. Through the array described above, a combination of one pixel and two sub-pixels adjacent to both sides of the pixel disposed in each row may include red, blue, green, and additional colors.

In a sub-pixel rendering process, various colors are represented using sub-pixels of adjacent pixels. Using the pixel pattern $PT_{11}$-3, the display device increases color expressiveness. Accordingly, the display device may provide images having increased color reproducibility.

Each row of the pixel pattern $PT_{11}$-3 includes at least one white sub-pixel, thereby increasing transmittance of a display device.

Figure 11:
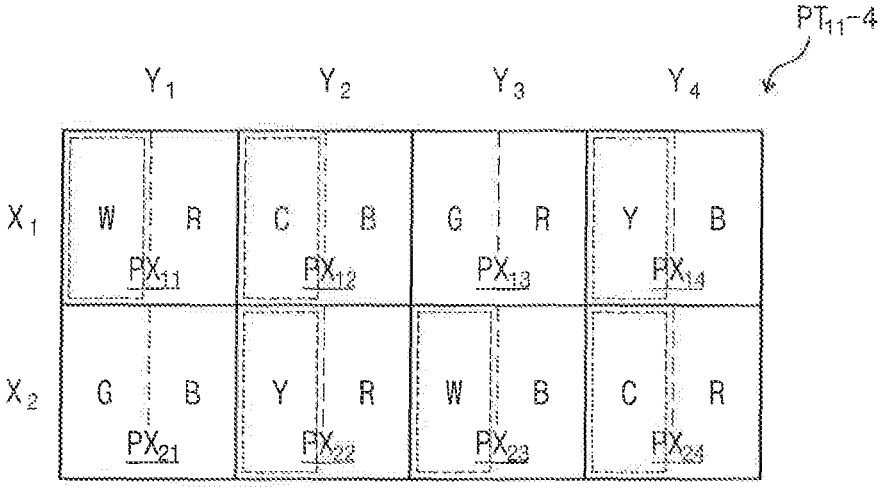
FIG. 11 is a view illustrating a pixel pattern according to an exemplary embodiment of the present invention.

FIG. 11 is a view illustrating a pixel pattern $PT_{11}$-4 according to an exemplary embodiment of the present invention. FIG. 11 illustrates the pixel pattern $PT_{11}$-4 having a 4×2 matrix including two rows $X_1$ and $X_2$ and four columns $Y_1$ to $Y_4$.

Referring to FIG. 11, the pixel pattern $PT_{11}$-4 includes eight pixels $PX_{11}$ to $PX_{24}$. The pixels $PX_{11}$ to $PX_{24}$ forming the respective rows include at least one primary pixel composed of primary color sub-pixels only and at least one non-primary pixel including a non-primary color sub-pixel. The pixel pattern $PT_{11}$-4 includes a first row X1 formed of one primary pixel $PX_{13}$ and three non-primary pixels $PX_{11}$, $PX_{12}$ and $PX_{14}$ and a second row $X_2$ formed of one primary pixel $PX_{21}$ and three non-primary pixels $PX_{22}$, $PX_{23}$ and $PX_{24}$.

The primary pixels $PX_{13}$ and $PX_{21}$ include two primary color sub-pixels selected from red, blue, and green primary color sub-pixels. The primary pixel $PX_{13}$ of the first row $X_1$ includes green and red primary color sub-pixels, and the primary pixel $PX_{21}$ of the second row $X_2$ includes green and blue primary color sub-pixels. The primary pixels $PX_{13}$ and $PX_{21}$ include a combination of mutually different colors for each row.

The complex pixels $PX_{11}$, $PX_{12}$, $PX_{14}$, $PX_{22}$, $PX_{23}$, and $PX_{24}$ include one primary color sub-pixel selected from red, blue, and green primary color sub-pixels and non-primary color sub-pixel. The non-primary color sub-pixel includes cyan, yellow, and white sub-pixels.

The complex pixels $PX_{11}$, $PX_{12}$, $PX_{14}$, $PX_{22}$, $PX_{23}$, and $PX_{24}$ include a pixel formed of white and red color sub-pixels, a pixel formed of cyan and blue color sub-pixels, and a pixel having yellow and blue color sub-pixels, disposed in the first row $X_1$ and a pixel having yellow and red color sub-pixels, a pixel having white and blue color sub-pixels, and a pixel having cyan and red color sub-pixels, disposed in the second row $X_2$. The complex pixels $PX_{11}$, $PX_{12}$, $PX_{14}$, $PX_{22}$, $PX_{23}$, and $PX_{24}$ may include a combination of mutually different colors.

In case of the pixel pattern $PX_{11}$-4, the respective pixels $PX_{11}$ to $PX_{24}$ do not include sub-pixels having the same color as that represented by adjacent pixels. The respective pixels $PX_{11}$ to $PX_{24}$ include sub-pixels having different colors from sub-pixels included in adjacent pixels.

Each of the rows X1 to X2 includes at least one white color sub-pixel and one of the other non-primary color sub-pixels such as cyan and yellow sub-pixels. The pixel pattern $PX_{11}$-4 includes all sub-pixels of white, cyan, and yellow colors for each of the respective rows $X_1$ and $X_2$.

Referring to FIG. 11, each pixel of the pixel pattern $PT_{11}$-4 includes a combination of sub-pixels from other pixels. Two adjacent pixels do not have a common sub-pixel. Each of the rows $X_1$ and $X_2$ includes one white color sub-pixel and one of cyan and yellow color sub-pixels.

A white point may be compensated by controlling a composition ratio of colors. For example, the pixel pattern $PT_{11}$-4 includes two cyan, yellow, green, and white color sub-pixels, and four red and blue color sub-pixels.

The number of the non-primary color sub-pixels is equal to the number of green color sub-pixels. The number of red and blue color sub-pixels is two times the number of green color sub-pixels. (note to client: no diagonality).

In the pixel pattern $PT_{11}$-4, the number of the non-primary color sub-pixels and green color sub-pixels is two times the number of red and blue color sub-pixels. The non-primary color and green color are sensitive to human eyes than the blue and red colors. The number of red and blue color sub-pixels is set according to the number of green color sub-pixels. The white point may be compensated by controlling the composition ratio between the number of green sub-pixels and the number of red and blue sub-pixels to increase color reproducibility.

Two adjacent pixels in each row include three primary color sub-pixels and one non-primary color sub-pixel. Using such sub-pixel configurations, the pixel pattern $PT_{11}$-4 represents various colors in a sub-pixel rendering process. Accordingly, color reproducibility, resolution and transmittance are increased.

According to an exemplary embodiment, the number of sub-pixels forming one logic pixel may be reduced, and adjacent pixels having different colors from each other provides an image having increased color reproducibility and resolution.

While the present invention has been shown and described with reference to exemplary embodiments thereof, it will be apparent to those of ordinary skill in the art that various changes in form and detail may be made therein without departing from the spirit and scope of the present invention as defined by the following claims.

What is claimed is:

1. A display device comprising:

a plurality of pixel patterns configured to display an image, wherein each of the plurality of pixel patterns is repetitively arranged in row and column directions, wherein each pixel pattern includes:

a plurality of primary pixels, wherein each primary pixel is composed of two primary color sub-pixels which provide two primary colors of three primary colors, wherein the three primary colors comprise red, green and blue;

a plurality of first complex pixels, wherein each first complex pixel is composed of one primary color sub-pixel which provide a remaining primary color of the three primary colors and a first non-primary color sub-pixel which provide a first color selected from non-primary colors, wherein the non-primary colors are different from the three primary colors; and a plurality of second complex pixels, wherein each second complex pixel is composed of one primary color sub-pixel configured to provide the remaining primary color and a second non-primary color sub-pixel configured to provide a second color selected from the non-primary colors, and wherein each of two colors which are provided by one pixel among the primary pixels, the first complex pixels, and the second complex pixels is different from each of two colors which are provided by each adjacent pixels to the one pixel in the row and the column directions.

2. The display device of claim 1, wherein the non-primary colors comprises yellow, magenta, cyan and white.

3. The display device of claim 1, wherein at least one of the plurality of primary pixels, at least one of the plurality of first complex pixels and at least one of the plurality of second complex pixels are arranged in a row direction.

4. The display device of claim 3, wherein one of the plurality of first complex pixels and one of the plurality of second complex pixels in the same row are apart from one of the plurality of primary pixels in the same row.

5. The display device of claim 4, wherein a number of the plurality of primary pixels is eight, a number of the plurality of first complex pixels is four, and a number of the plurality of second complex pixels is four, wherein the pixel pattern is formed of an M×N matrix, wherein M represents a number of columns and N represents a number of rows and, wherein M is four and N is four.

6. The display device of claim 4, wherein each pixel pattern further comprises:

a plurality of third complex pixels, wherein each third complex pixel is composed of the one primary color sub-pixel and a second non-primary color sub-pixel configured to provide a third color selected from the non-primary colors, wherein the third color is different from the first and second colors.

7. The display device of claim 6, wherein the third color is a white color.

8. The display device of claim 7, wherein a number of the plurality of primary pixels is four, a number of the plurality of first complex pixels is one, a number of the plurality of second complex pixels is one, and a number of the plurality of third complex pixels is two, wherein the pixel pattern is formed of a 4×2 matrix, wherein each row of the 4×2 matrix includes at least one of the plurality of third complex pixels.

9. The display device of claim 6, wherein a number of the plurality of primary pixels is eight, a number of the plurality of first complex pixels is two, a number of the plurality of second complex pixels is two, and a number of the plurality of third complex pixels is four, wherein the pixel pattern is formed of a 4×4 matrix, wherein each row of the 4×4 matrix comprises one of the plurality of third complex pixels.

10. The display device of claim 9, wherein each of the rows of the 4×4 matrix comprises at least one of the plurality of primary pixels, at least one of the plurality of first complex pixels and at least one of the plurality of third complex pixels that are arranged in a row direction.

11. The display device of claim 4, wherein the plurality of primary pixels is diagonally arranged in a same pixel pattern.

12. The display device of claim 11, wherein the plurality of first complex pixels and the plurality of second complex pixels are diagonally respectively arranged in the same pixel pattern.

13. The display device of claim 11, wherein at least one of the plurality of first complex pixels and at least one of the plurality of second complex pixels are arranged in a same diagonal direction.

14. A display device comprising:

a plurality of pixel patterns configured to display an image, wherein each of the plurality of pixel patterns is repetitively arranged in row and column directions, wherein each pixel pattern comprises:

a plurality of first pixels, wherein each of the plurality of the first pixels is composed of two primary color sub-pixels which provide two primary colors of a plurality of primary colors; and a plurality of second pixels, wherein each of the plurality of the second pixels is composed of one primary color sub-pixel which provide a primary color different from the two primary colors of the primary colors and a first non-primary color sub-pixel which provide a first color selected from non-primary colors, wherein the non-primary colors different from the primary colors, wherein each of the plurality of the first pixels is adjacent to at least one of the plurality of the second pixels in the row or the column directions, wherein each of the first pixels is arranged alternately in the row and column directions with each of the second pixels, and wherein each of colors which are provided by one first pixel among the first pixels is different from each of colors which are provided by each of adjacent second pixels to the one first pixel.

15. The display device of claim 14, wherein the non-primary colors comprises a cyan color, a yellow color, a magenta color or a white color.

16. The display device of claim 15, further comprising a plurality of third pixels, wherein each of the plurality of the third pixels is composed of one primary color sub-pixel configured to provide a primary color different from the two primary colors of the primary colors and a second color sub-pixel configured to provide a second color selected from the non-primary colors, the second color different from the first color, and wherein at least one of the first pixels, at one of the second pixels, and at least one of the third pixels arranged in each rows.

17. The display device of claim 16, wherein each of sub-pixels in each row is configured to provide the white color.

18. The display device of claim 17, wherein the plurality of first pixels is diagonally arranged.

* * * * *